US009989279B2

(12) United States Patent
Huff et al.

(10) Patent No.: US 9,989,279 B2
(45) Date of Patent: Jun. 5, 2018

(54) REFRIGERANT VAPOR COMPRESSION SYSTEM WITH INTERCOOLER

(75) Inventors: Hans-Joachim Huff, Mainz (DE); KeonWoo Lee, Manilus, NY (US); Lucy Yi Liu, Fayetteville, NY (US); Suresh Duraisamy, Liverpool, NY (US); Zvonko Asprovski, Liverpool, NY (US); Kursten Lamendola, Chittenango, NY (US); Alexander Lifson, Manilus, NY (US)

(73) Assignee: CARRIER CORPORATION, Farmington, CT (US)

( * ) Notice: Subject to any disclaimer, the term of this patent is extended or adjusted under 35 U.S.C. 154(b) by 1474 days.

(21) Appl. No.: 13/581,528

(22) PCT Filed: Mar. 25, 2011

(86) PCT No.: PCT/US2011/029936

§ 371 (c)(1),
(2), (4) Date: Aug. 28, 2012

(87) PCT Pub. No.: WO2011/139425

PCT Pub. Date: Nov. 10, 2011

(65) Prior Publication Data

US 2013/0031934 A1 Feb. 7, 2013

Related U.S. Application Data

(60) Provisional application No. 61/329,332, filed on Apr. 29, 2010.

(51) Int. Cl.
*F25B 1/00* (2006.01)
*F25B 1/10* (2006.01)
(Continued)

(52) U.S. Cl.
CPC ..... *F25B 1/10* (2013.01); *F28D 7/10* (2013.01); *F25B 2309/061* (2013.01);
(Continued)

(58) Field of Classification Search
CPC .... F25B 1/00; F25B 1/10; F25B 41/00; F25B 7/00; F25B 9/008; F25B 9/10;
(Continued)

(56) References Cited

U.S. PATENT DOCUMENTS 2,621,903 A * 12/1952 Cohler ..... 165/11.1
3,013,403 A 12/1961 Grant et al.
(Continued)

FOREIGN PATENT DOCUMENTS

CN 101688697 A 3/2010
CN 101688698 A 3/2010
(Continued)

OTHER PUBLICATIONS

PCT International Search Report and Written Opinion of the International Searching Authority for International Application No. PCT/US2011/029936, dated Dec. 13, 2012, 5 pages.
(Continued)

*Primary Examiner* — Frantz Jules
*Assistant Examiner* — Erik Mendoza-Wilkenfel
(74) *Attorney, Agent, or Firm* — Cantor Colburn LLP

(57) ABSTRACT

A refrigerant vapor compression system includes a compression device having at least a first compression stage and a second compression stage, a refrigerant heat rejection heat exchanger disposed downstream with respect to refrigerant flow of the second compression stage, and a refrigerant intercooler disposed intermediate the first compression stage and the second compression stage. The refrigerant intercooler is disposed downstream of the refrigerant heat rejection heat exchanger with respect to the flow of a secondary
(Continued)

fluid. A second refrigerant heat rejection heat exchanger may be disposed downstream with respect to refrigerant flow of the aforesaid refrigerant heat rejection heat exchanger, and a second refrigerant intercooler may be disposed intermediate the first compression stage and the second compression stage and downstream with respect to refrigerant flow of the aforesaid refrigerant intercooler.

9 Claims, 9 Drawing Sheets

(51) Int. Cl.

| | |
|---|---|
| ***F25B 41/00*** | (2006.01) |
| ***F25B 7/00*** | (2006.01) |
| ***F25B 9/10*** | (2006.01) |
| ***F28D 1/04*** | (2006.01) |
| ***F28D 3/02*** | (2006.01) |
| ***F28D 7/00*** | (2006.01) |
| ***F28D 7/10*** | (2006.01) |

(52) U.S. Cl.
CPC ..... *F25B 2400/04* (2013.01); *F25B 2400/072* (2013.01); *F25B 2400/13* (2013.01)

(58) Field of Classification Search
CPC ..... F25B 40/02; F25D 17/06; F28D 1/0246; F28D 1/04; F28D 3/02; F28D 7/00; F28D 7/0041; F28D 7/0008; F28D 7/0016; F28D 7/0033; F28D 7/0066; F28D 1/0408
USPC ..... 165/140
See application file for complete search history.

(56) References Cited

U.S. PATENT DOCUMENTS

| | | | | |
|---|---|---|---|---|
| 4,062,188 | A * | 12/1977 | Cutler et al. | 60/599 |
| 4,474,018 | A | 10/1984 | Teagan | |
| 4,569,207 | A * | 2/1986 | James | 62/235.1 |
| 4,787,211 | A | 11/1988 | Shaw | |
| 5,265,437 | A * | 11/1993 | Saperstein et al. | 62/243 |
| 5,996,356 | A * | 12/1999 | Kishimoto et al. | 62/117 |
| 6,581,408 | B1 * | 6/2003 | Tadano | F25B 1/10 62/199 |
| 6,848,268 | B1 | 2/2005 | Memory et al. | |
| 7,062,938 | B2 * | 6/2006 | Lee | 62/506 |
| 7,631,510 | B2 | 12/2009 | Radermacher et al. | |
| 2001/0023594 | A1 | 9/2001 | Ives | |
| 2005/0210891 | A1 | 9/2005 | Matsumoto et al. | |
| 2005/0279127 | A1 * | 12/2005 | Jia et al. | 62/510 |
| 2008/0302113 | A1 * | 12/2008 | Yin et al. | 62/115 |
| 2009/0241566 | A1 * | 10/2009 | Bush et al. | 62/115 |
| 2010/0032133 | A1 * | 2/2010 | Lifson et al. | 165/62 |
| 2010/0071407 | A1 * | 3/2010 | Taras et al. | 62/507 |
| 2010/0170295 | A1 * | 7/2010 | Okazaki et al. | 62/510 |
| 2010/0199694 | A1 * | 8/2010 | Taras | F25B 1/10 62/117 |
| 2010/0258005 | A1 * | 10/2010 | Oishi | F22D 1/003 95/156 |
| 2010/0326100 | A1 * | 12/2010 | Taras et al. | 62/115 |
| 2011/0036110 | A1 * | 2/2011 | Fujimoto et al. | 62/149 |
| 2011/0036118 | A1 | 2/2011 | Okazaki | |

FOREIGN PATENT DOCUMENTS

| | | | |
|---|---|---|---|
| JP | 2004085105 | A | 3/2004 |
| WO | WO2008057090 | A1 | 5/2008 |
| WO | 2008079128 | | 7/2008 |
| WO | 2009069603 | A1 | 6/2009 |
| WO | 2009069678 | A1 | 6/2009 |
| WO | 2009082405 | | 7/2009 |
| WO | WO2009105092 | A1 | 8/2009 |
| WO | 2009130929 | | 10/2009 |
| WO | WO2009119375 | A1 | 10/2009 |
| WO | WO2009147882 | A1 | 12/2009 |

OTHER PUBLICATIONS

PCT International Preliminary Report on Patentability and Written Opinion of the International Searching Authority for International Application No. PCT/US2011/029936, dated Jan. 24, 2013, 10 pages.

Chinese Office Action for application CN 201180021559.7, dated Jul. 3, 2014, 16 pages.

European Office Action for application 11712140.0, dated Jun. 16, 2016, 4 pages.

* cited by examiner

REFRIGERANT VAPOR COMPRESSION SYSTEM WITH INTERCOOLER

CROSS-REFERENCE TO RELATED APPLICATION

This application claims priority to U.S. Provisional Patent Application Ser. No. 61/329,332 entitled "Refrigerant Vapor Compression System with Intercooler" filed on Apr. 29, 2010, the content of which is incorporated herein by reference in its entirety.

FIELD OF THE INVENTION

This invention relates generally to refrigerant vapor compression systems and, more particularly, to improving the energy efficiency and/or cooling capacity of a refrigerant vapor compression system incorporating a multi-stage compression device, for example a two-stage compressor, and more particularly to a refrigerant vapor compression system incorporating a two-stage compressor and an intercooler for cooling refrigerant passing between the compression stages.

BACKGROUND OF THE INVENTION

Refrigerant vapor compression systems are well known in the art and commonly used for conditioning air to be supplied to a climate controlled comfort zone within a residence, office building, hospital, school, restaurant or other facility. Refrigerant vapor compression systems are also commonly used in refrigerating air supplied to display cases, merchandisers, freezer cabinets, cold rooms or other perishable/frozen product storage area in commercial establishments. Refrigerant vapor compression systems are also commonly used in transport refrigeration systems for refrigerating air supplied to a temperature controlled cargo space of a truck, trailer, container or the like for transporting perishable/frozen items by truck, rail, ship or intermodally.

Refrigerant vapor compression systems used in connection with transport refrigeration systems are generally subject to more stringent operating conditions due to the wide range of operating load conditions and the wide range of outdoor ambient conditions over which the refrigerant vapor compression system must operate to maintain product within the cargo space at a desired temperature. The desired temperature at which the cargo needs to be controlled can also vary over a wide range depending on the nature of cargo to be preserved. The refrigerant vapor compression system must not only have sufficient capacity to rapidly pull down the temperature of product loaded into the cargo space at ambient temperature, but also should operate energy efficiently over the entire load range, including at low load when maintaining a stable product temperature during transport.

A typical refrigerant vapor compression system includes a compression device, a refrigerant heat rejection heat exchanger, a refrigerant heat absorption heat exchanger, and an expansion device disposed upstream, with respect to refrigerant flow, of the refrigerant heat absorption heat exchanger and downstream of the refrigerant heat rejection heat exchanger. These basic refrigerant system components are interconnected by refrigerant lines in a closed refrigerant circuit, arranged in accord with known refrigerant vapor compression cycles. It is also known practice to incorporate an economizer into the refrigerant circuit for increasing the capacity of the refrigerant vapor compression system. For example, a refrigerant-to-refrigerant heat exchanger or a flash tank may be incorporated into the refrigerant circuit as an economizer. The economizer circuit includes a vapor injection line for conveying refrigerant vapor from the economizer into an intermediate pressure stage of the compression process.

Traditionally, most of these refrigerant vapor compression systems have been operated at subcritical refrigerant pressures. Refrigerant vapor compression systems operating in the subcritical range are commonly charged with fluorocarbon refrigerants such as, but not limited to, hydrochlorofluorocarbons (HCFCs), such as R22, and more commonly hydrofluorocarbons (HFCs), such as R134a, R410A, R404A and R407C. However, greater interest is being shown in "natural" refrigerants, such as carbon dioxide, for use in refrigeration systems instead of HFC refrigerants. Because carbon dioxide has a low critical temperature, most refrigerant vapor compression systems charged with carbon dioxide as the refrigerant are designed for operation in the transcritical pressure regime.

In refrigerant vapor compression systems operating in a subcritical cycle, both the refrigerant heat rejection heat exchanger, which functions in a subcritical cycle as a condenser, and the refrigerant heat absorption heat exchanger, which functions as an evaporator, operate at refrigerant temperatures and pressures below the refrigerant's critical point. However, in refrigerant vapor compression systems operating in a transcritical cycle, the refrigerant heat rejection heat exchanger operates at a refrigerant temperature and pressure in excess of the refrigerant's critical point, while the refrigerant heat absorption heat exchanger, i.e. the evaporator, operates at a refrigerant temperature and pressure in the subcritical range. Operating at refrigerant pressure and refrigerant temperature in excess of the refrigerant's critical point, the refrigerant heat rejection heat exchanger functions as a gas cooler rather than as a condenser.

In multi-stage compression systems it is known that the operational envelope of the compression device can often be extended by incorporating a refrigerant to secondary fluid heat exchanger into the refrigerant circuit between two compression stages. Commonly referred to as an intercooler, this heat exchanger provides for passing refrigerant flowing from one compression stage to another compression stage in heat exchange relationship with a cooler fluid whereby the refrigerant is cooled. Typically, the cooler fluid is a secondary fluid and the heat extracted from the refrigerant is carried away by the secondary fluid. However, incorporating an intercooler into a refrigerant vapor compression system in accord with previous practice may not be practical in some situations, for example due to physical space, weight and equipment cost considerations. Such considerations are particularly relevant in transport refrigeration applications where it is generally desirable to minimize weight, size and cost of the components of the refrigerant vapor compression system. The higher refrigerant pressures associated with operation in a transcritical refrigeration cycle, such as in refrigerant vapor compression systems using carbon dioxide as the refrigerant, complicates incorporation of an intercooler into the refrigerant circuit.

SUMMARY OF THE INVENTION

An intercooler is incorporated into a refrigeration vapor compression system having at least a two stage compression device in such a manner as to improve energy efficiency and cooling capacity of the refrigerant vapor compression system, particularly when the system is operating in a transcritical cycle with a refrigerant such as carbon dioxide.

In an aspect, the refrigerant vapor compression system includes a compression device having at least a first compression stage and a second compression stage, a refrigerant heat rejection heat exchanger disposed downstream with respect to refrigerant flow of the second compression stage, and a refrigerant intercooler disposed intermediate the first compression stage and the second compression stage. The refrigerant intercooler is disposed downstream of the refrigerant heat rejection heat exchanger with respect to the flow of a secondary fluid. In an embodiment, the secondary fluid comprises air and the refrigerant vapor compression system further includes at least one fan operatively associated with the refrigerant heat rejection heat exchanger and with the intercooler for moving the flow of air first through the refrigerant heat rejection heat exchanger and thence through the refrigerant intercooler.

In an aspect, the refrigerant vapor compression system includes a compression device having at least a first compression stage and a second compression stage, a first refrigerant heat rejection heat exchanger disposed downstream with respect to refrigerant flow of the second compression stage, a second refrigerant heat rejection heat exchanger disposed downstream with respect to refrigerant flow of the first refrigerant heat rejection heat exchanger, a first refrigerant intercooler disposed intermediate the first compression stage and the second compression stage, and a second refrigerant intercooler disposed intermediate the first compression stage and the second compression stage and downstream with respect to refrigerant flow of the first refrigerant intercooler. The refrigerant passing through the first refrigerant heat rejection heat exchanger and the first refrigerant intercooler passes in heat exchange relationship with a first secondary fluid and the refrigerant passing through the second refrigerant heat rejection heat exchanger and the second refrigerant intercooler passes in heat exchange relationship with a second secondary fluid. In an embodiment, the first secondary fluid comprises air and the refrigerant vapor compression system further includes at least one fan operatively associated with the first refrigerant heat rejection heat exchanger and with the first refrigerant intercooler for moving the flow of air first through the first refrigerant heat rejection heat exchanger and thence through the first refrigerant intercooler. In an embodiment, the second secondary fluid comprises at least one of water and glycol and the refrigerant vapor compression system further includes at least one pump operatively associated with the second refrigerant heat rejection heat exchanger and with the second refrigerant intercooler for moving the flow of water or glycol or mixture thereof first through the second refrigerant heat rejection heat exchanger and thence through the second refrigerant intercooler.

In another aspect, a refrigerant vapor compression system is provided that includes a compression device having at least a first compression stage and a second compression stage, and a refrigerant to secondary liquid heat exchanger including a first refrigerant flow passage, a second refrigerant flow passage and a secondary liquid flow passage in heat exchange relationship with each of the first refrigerant flow passage and the second refrigerant flow passage. The first refrigerant flow passage is disposed downstream with respect to refrigerant flow of the second compression stage and the second refrigerant flow passage is disposed intermediate the first compression stage and the second compression stage. In an embodiment, the refrigerant to secondary fluid heat exchanger includes a first refrigerant tube defining the first refrigerant flow passage, a second refrigerant tube defining the second refrigerant flow passage, and a cooling liquid tube defining the secondary liquid flow passage. In an embodiment, the first and second refrigerant tubes are disposed on opposite sides of the cooling liquid tube.

BRIEF DESCRIPTION OF THE DRAWINGS

For a further understanding of the disclosure, reference will be made to the following detailed description which is to be read in connection with the accompanying drawing, wherein.

DETAILED DESCRIPTION OF THE INVENTION

Figure 1:
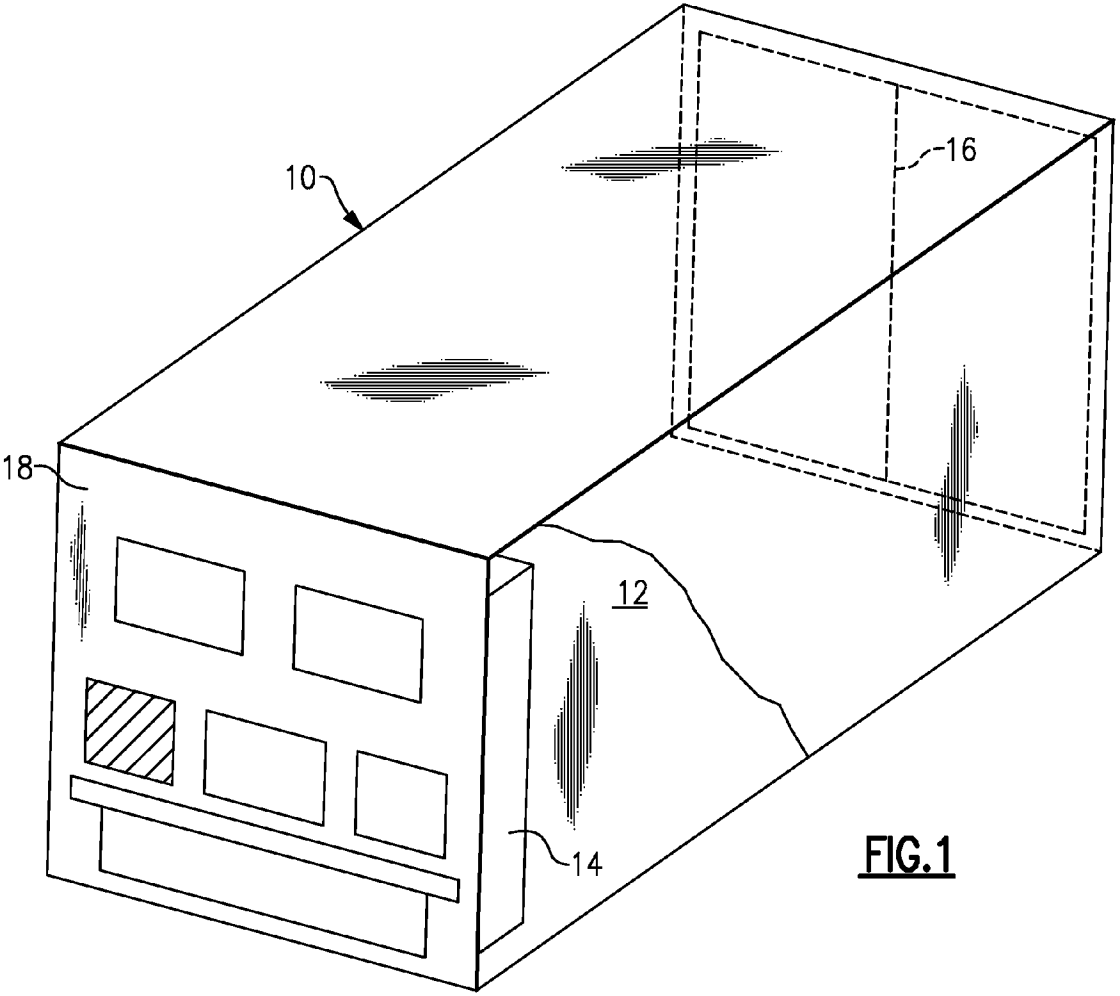
FIG. 1 is perspective view of a refrigerated container equipped with a transport refrigeration system.
Figure 2:
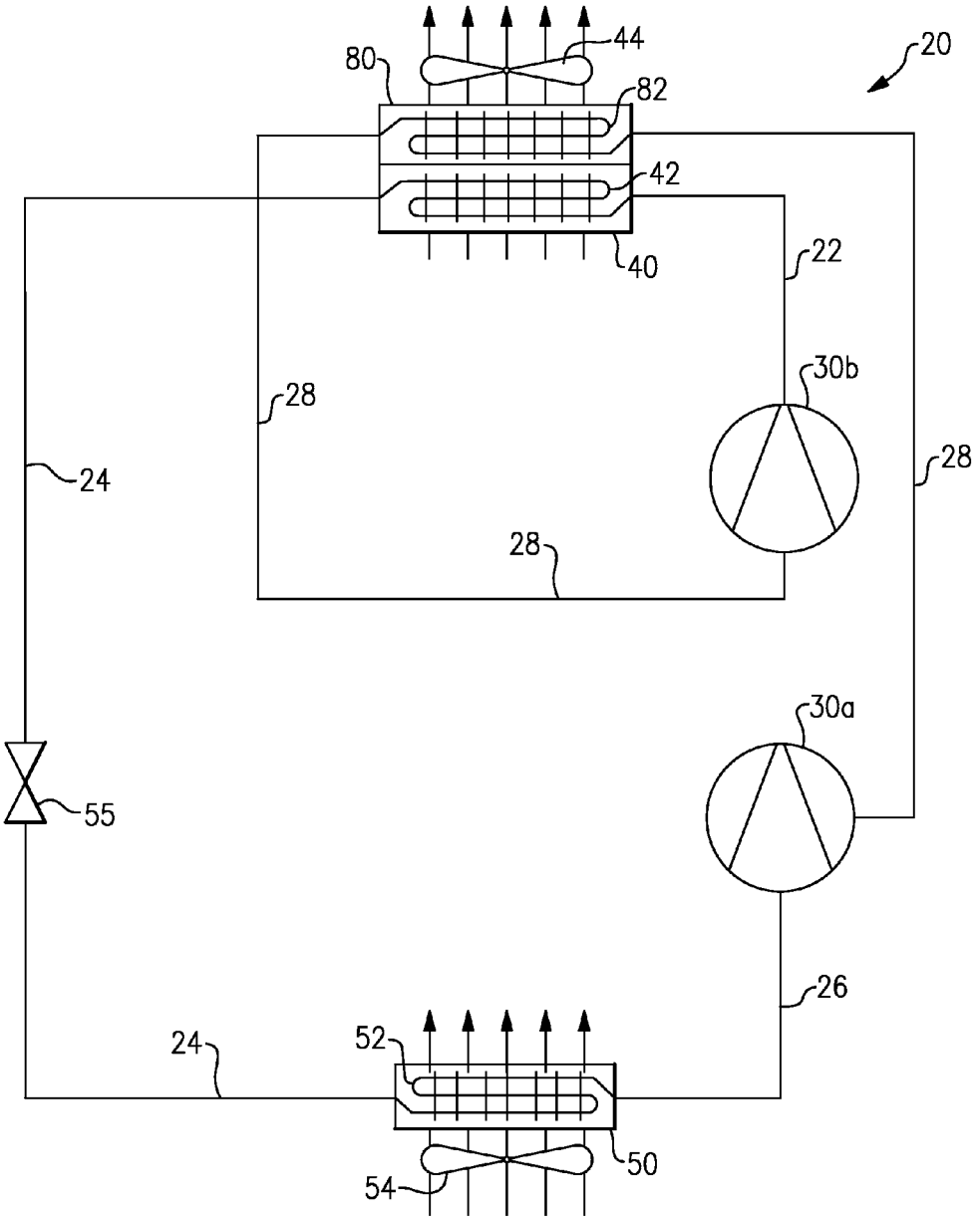
FIG. 2 is a schematic illustration of an embodiment of the refrigerant vapor compression system in accord with an aspect of the invention.

There is depicted in FIG. 1 an exemplary embodiment of a refrigerated container 10 having a temperature controlled cargo space 12 the atmosphere of which is refrigerated by operation of a refrigeration unit 14 associated with the cargo space 12. In the depicted embodiment of the refrigerated container 10, the refrigeration unit 14 is mounted in a wall of the refrigerated container 10, typically in the front wall 18 in conventional practice. However, the refrigeration unit 14 may be mounted in the roof, floor or other walls of the refrigerated container 10. Additionally, the refrigerated container 10 has at least one access door 16 through which perishable goods, such as, for example, fresh or frozen food products, may be loaded into and removed from the cargo space 12 of the refrigerated container 10.

Referring now to FIGS. 2-7, there are depicted schematically various exemplary embodiments of a refrigerant vapor compression system 20 suitable for use in the refrigeration unit 14 for refrigerating air drawn from and supplied back to the temperature controlled cargo space 12. Although the refrigerant vapor compression system 20 will be described herein in connection with a refrigerated container 10 of the type commonly used for transporting perishable goods by ship, by rail, by land or intermodally, it is to be understood that he refrigerant vapor compression system 20 may also be used in refrigeration units for refrigerating the cargo space of a truck, a trailer or the like for transporting perishable goods. The refrigerant vapor compression system 20 is also suitable for use in conditioning air to be supplied to a climate controlled comfort zone within a residence, office building, hospital, school, restaurant or other facility. The refrigerant vapor compression system 20 could also be employed in refrigerating air supplied to display cases, merchandisers, freezer cabinets, cold rooms or other perishable and frozen product storage areas in commercial establishments.

The refrigerant vapor compression system 20 includes a multi-stage compression device 30, a refrigerant heat rejection heat exchanger 40, also referred to herein as a gas cooler, a refrigerant heat absorption heat exchanger 50, also referred to herein as an evaporator, and a primary expansion device 55, such as for example an electronic expansion valve or a thermostatic expansion valve, operatively associated with the evaporator 50, with various refrigerant lines 22, 24 26 and 28 connecting the aforementioned components in a primary refrigerant circuit.

The compression device 30 functions to compress the refrigerant and to circulate refrigerant through the primary refrigerant circuit as will be discussed in further detail hereinafter. The compression device 30 may comprise a single, multiple-stage refrigerant compressor, for example a reciprocating compressor, having a first compression stage 30*a* and a second stage 30*b*, or may comprise a pair of compressors 30*a* and 30*b*, connected in series refrigerant flow relationship in the primary refrigerant circuit via a refrigerant line 28 connecting the discharge outlet port of the first compression stage compressor 30*a* in refrigerant flow communication with the suction inlet port of the second compression stage compressor 30*b*. The first and second compression stages 30*a* and 30*b* are disposed in series refrigerant flow relationship with the refrigerant leaving the first compression stage 30*a* passing to the second compression stage 30*b* for further compression. In the first compression stage the refrigerant vapor is compressed from a lower pressure to an intermediate pressure. In the second compression stage, the refrigerant vapor is compressed from an intermediate pressure to higher pressure. In a two compressor embodiment, the compressors may be scroll compressors, screw compressors, reciprocating compressors, rotary compressors or any other type of compressor or a combination of any such compressors.

The refrigerant heat rejection heat exchanger 40 may comprise a finned tube heat exchanger 42 through which hot, high pressure refrigerant discharged from the second compression stage 30*b* (i.e. the final compression charge) passes in heat exchange relationship with a secondary fluid, most commonly ambient air drawn through the heat exchanger 42 by the fan(s) 44. The finned tube heat exchanger 42 may comprise, for example, a fin and round tube heat exchange coil or a fin and flat mini-channel tube heat exchanger. If the pressure of the refrigerant discharging from the second compression stage 30*b*, commonly referred to as the compressor discharge pressure exceeds the critical point of the refrigerant, the refrigerant vapor compression system 20 operates in a transcritical cycle and the refrigerant heat rejection heat exchanger 40 functions as a gas cooler. If the compressor discharge pressure is below the critical point of the refrigerant, the refrigerant vapor compression system 20 operates in a subcritical cycle and the refrigerant heat rejection heat exchanger 40 functions as a condenser.

The refrigerant heat absorption heat exchanger 50 may also comprise a finned tube coil heat exchanger 52, such as a fin and round tube heat exchanger or a fin and flat, mini-channel tube heat exchanger. The refrigerant heat absorption heat exchanger 50 functions as a refrigerant evaporator whether the refrigerant vapor compression system is operating in a transcritical cycle or a subcritical cycle. Before entering the refrigerant heat absorption heat exchanger 50, the refrigerant passing through refrigerant line 24 traverses the expansion device 55, such as, for example, an electronic expansion valve or a thermostatic expansion valve, and expands to a lower pressure and a lower temperature to enter heat exchanger 52. As the liquid refrigerant traverses the heat exchanger 52, the liquid refrigerant passes in heat exchange relationship with a heating fluid whereby the liquid refrigerant is evaporated and typically superheated to a desired degree. The low pressure vapor refrigerant leaving heat exchanger 52 passes through refrigerant line 26 to the suction inlet of the first compression stage 30*a*. The heating fluid may be air drawn by an associated fan(s) 54 from a climate controlled environment, such as a perishable/frozen cargo storage zone associated with a transport refrigeration unit, or a food display or storage area of a commercial establishment, or a building comfort zone associated with an air conditioning system, to be cooled, and generally also dehumidified, and thence returned to a climate controlled environment.

In the embodiments depicted in FIGS. 3, 4 and 6, 7, the refrigerant vapor compression system 20 further includes and economizer circuit associated with the primary refrigerant circuit. The economizer circuit includes an economizer device 60, 70, an economizer circuit expansion device 65 and a vapor injection line in refrigerant flow communication with an intermediate pressure stage of the compression process. In the embodiments depicted in FIGS. 3 and 6, the economizer device comprises a flash tank economizer 60. In the embodiments depicted in FIGS. 4 and 7, the economizer device comprises a refrigerant-to-refrigerant heat exchanger 70. The economizer expansion device 65 may, for example, be an electronic expansion valve, a thermostatic expansion valve or a fixed orifice expansion device.

Figure 3:
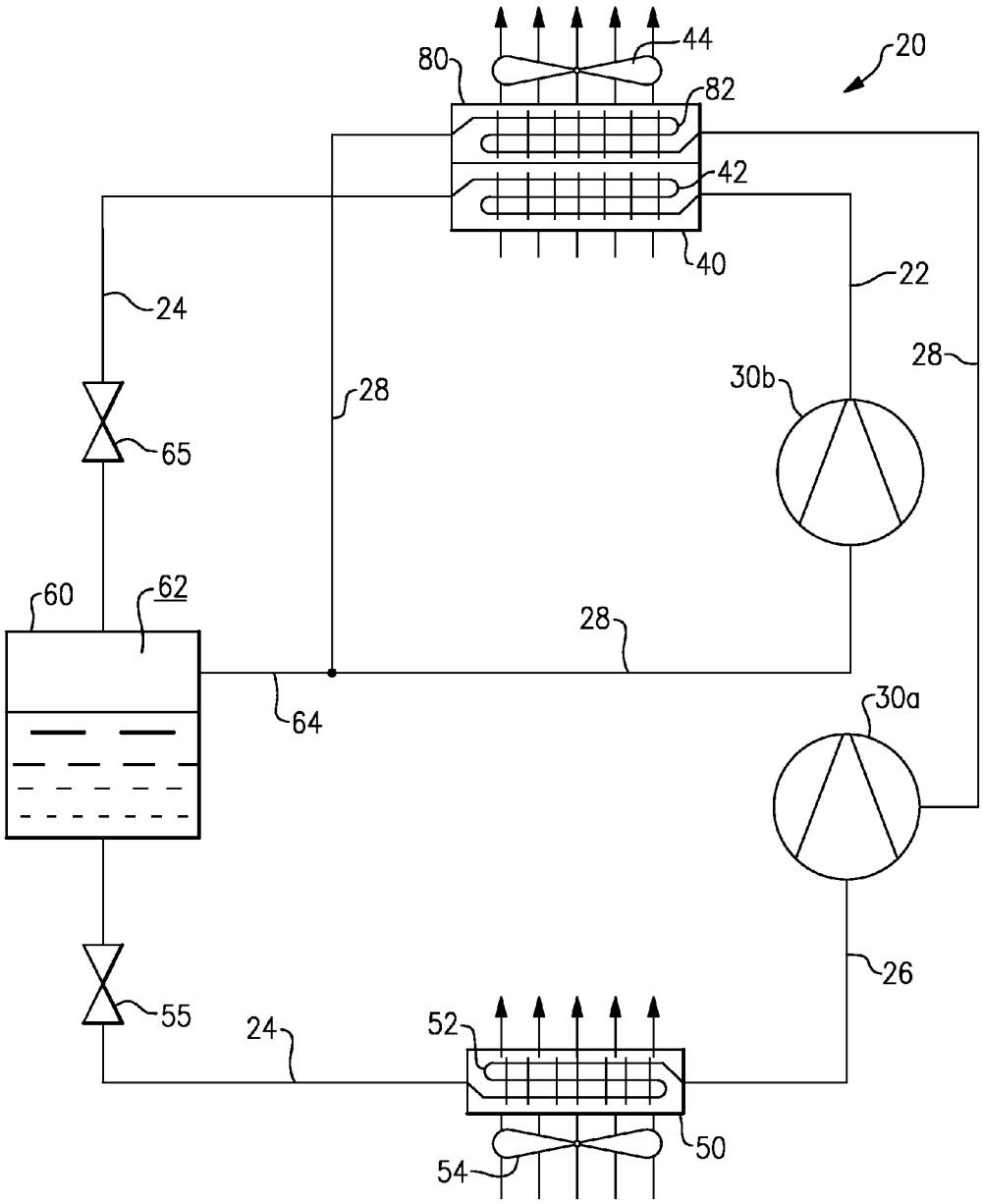
FIG. 3 is a schematic illustration of an alternate embodiment of the refrigerant vapor compression system illustrated in FIG. 1.
Figure 6:
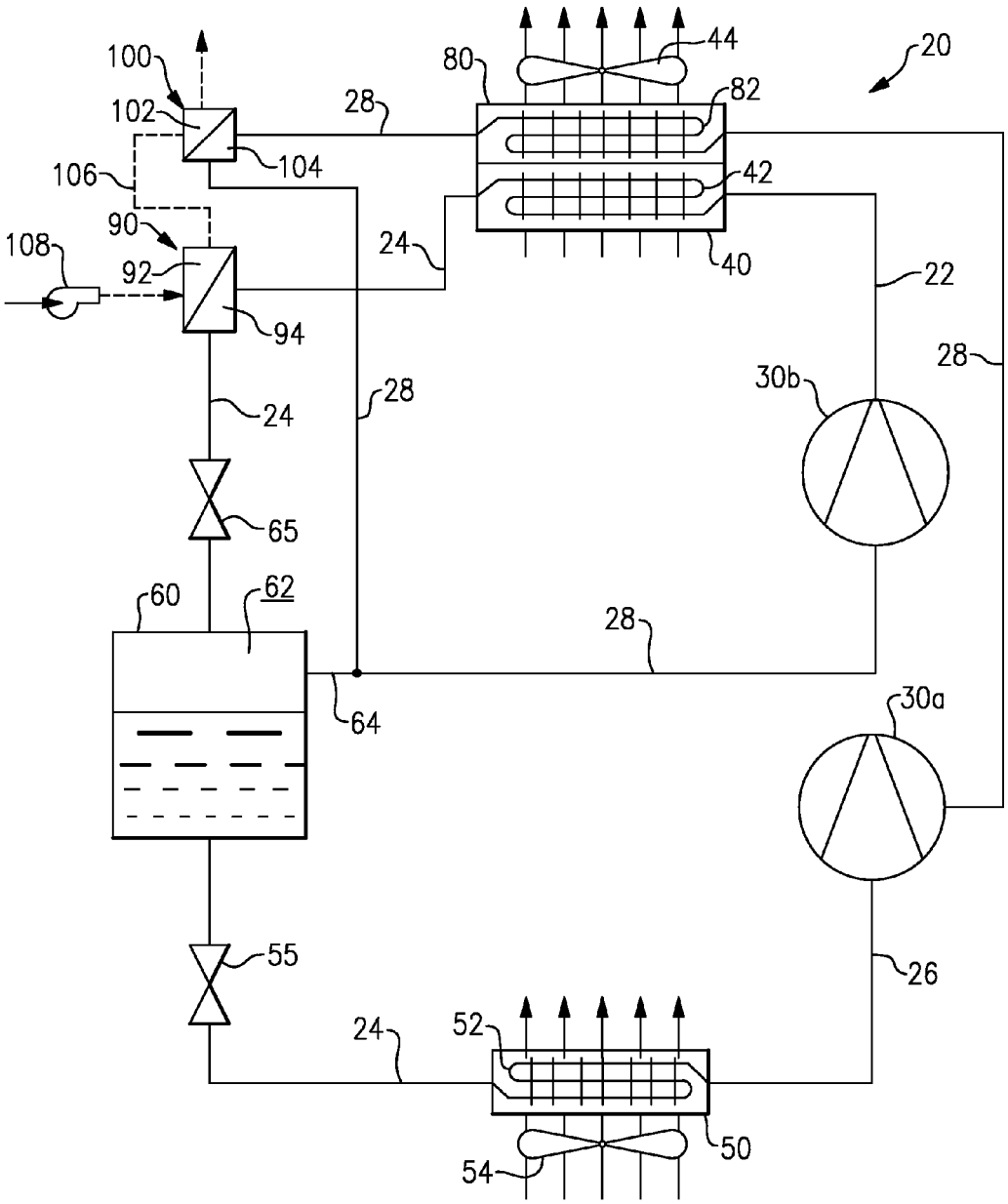
FIG. 6 is a schematic illustration of an alternate embodiment of the refrigerant vapor compression system illustrated in FIG. 5.

Referring now to FIGS. 3 and 6, in particular, the flash tank economizer 60 is interdisposed in refrigerant line 24 between the refrigerant heat rejection heat exchanger 40 and the primary expansion device 55. The economizer circuit expansion device 65 is disposed in refrigerant line 24 upstream of the flash tank economizer 60. The flash tank economizer 60 defines a chamber 62 into which expanded refrigerant having traversed the economizer circuit expansion device 65 enters and separates into a liquid refrigerant portion and a vapor refrigerant portion. The liquid refrigerant collects in the chamber 62 and is metered therefrom through the downstream leg of refrigerant line 24 by the primary expansion device 55 to flow to the refrigerant heat absorption heat exchanger 50. The vapor refrigerant collects in the chamber 62 above the liquid refrigerant and passes therefrom through vapor injection line 64 for injection of refrigerant vapor into an intermediate stage of the compression process. In the depicted embodiments, the vapor injection line 64 communicates with refrigerant line 28 interconnecting the outlet of the first compression stage 30*a* to the inlet of the second compression stage 30*b*. A check valve (not shown) may be interdisposed in vapor injection line 64 upstream of its connection with refrigerant line 28 to prevent backflow through vapor injection line 64. It is to be understood, however, that refrigerant vapor injection line 64 can open directly into an intermediate stage of the compression process rather than opening into refrigerant line 28.

Figure 4:
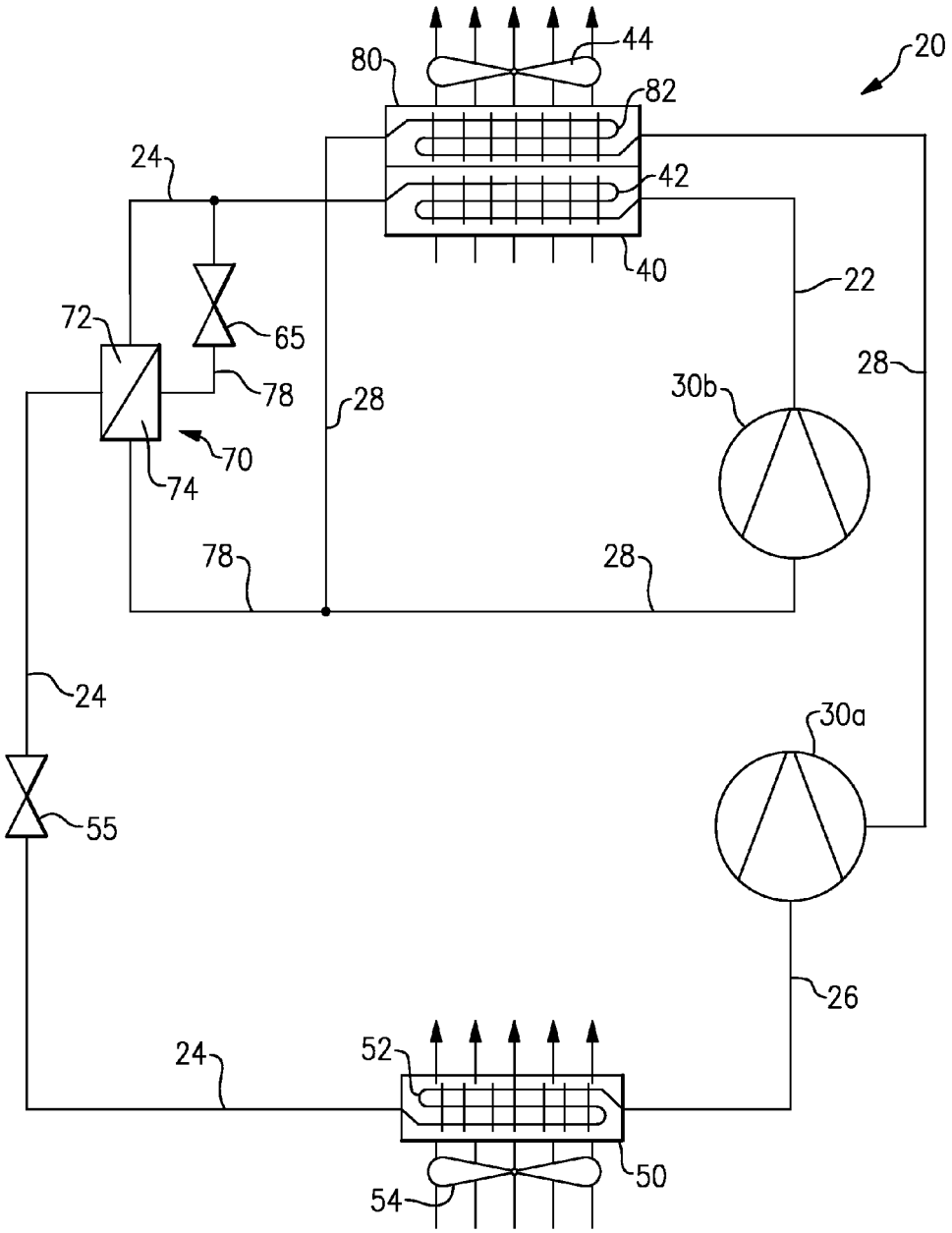
FIG. 4 is a schematic illustration of an alternate embodiment of the refrigerant vapor compression system illustrated in FIG. 1.
Figure 7:
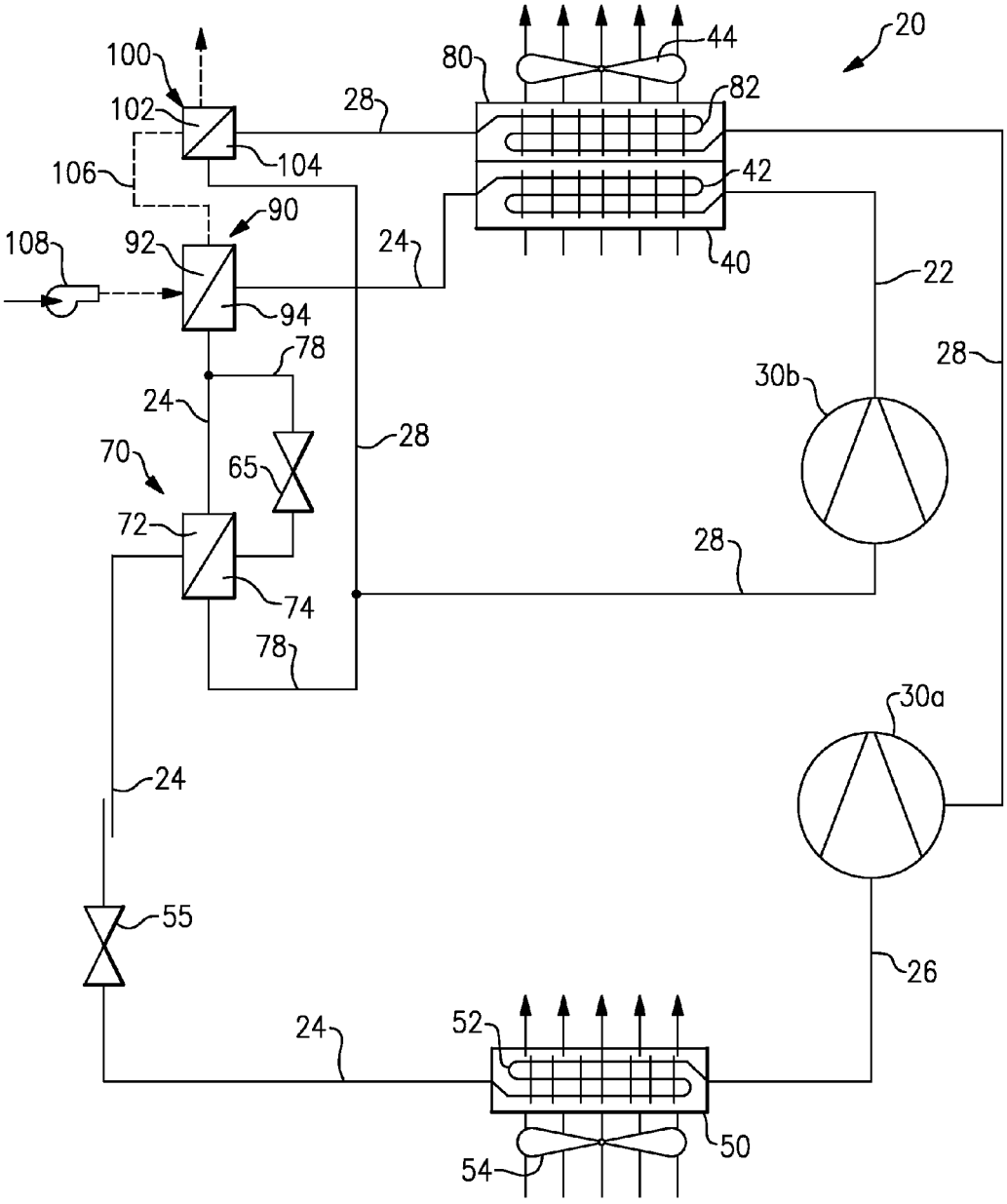
FIG. 7 is a schematic illustration of an alternate embodiment of the refrigerant vapor compression system illustrated in FIG. 5.

Referring now to FIGS. 4 and 7, in particular, the refrigerant-to-refrigerant heat exchanger economizer 70 includes a first refrigerant pass 72 and a second refrigerant pass 74 arranged in heat transfer relationship. The first refrigerant pass 72 is interdisposed in refrigerant line 24 and forms part of the primary refrigerant circuit. The second refrigerant pass 74 is interdisposed in refrigerant line 78 that forms part of an economizer circuit. The economizer circuit refrigerant line 78 taps into refrigerant line 24 and connects in refrigerant flow communication with an intermediate pressure stage of the compression process. In the exemplary embodiment depicted in FIGS. 4 and 7, the economizer circuit refrigerant line 78 taps into refrigerant line 24 of the primary refrigerant circuit upstream with respect to refrigerant flow of the first pass 72 of the refrigerant-to-refrigerant heat exchanger economizer 70 and communicates with refrigerant line 28 interconnecting the outlet of the first compression stage 30*a* to the inlet of the second compression stage 30*b*. A check valve (not shown) may be interdisposed in refrigerant line 78 downstream of the second refrigerant pass 74 and upstream of its connection with refrigerant line 28 to prevent backflow through refrigerant line 78. The first refrigerant pass 72 and the second refrigerant pass 74 of the refrigerant-to-refrigerant heat exchanger economizer 70 may be arranged in a parallel flow heat exchange relationship or in a counter flow heat exchange relationship, as desired. The refrigerant-to-refrigerant heat exchanger 70 may be a brazed plate heat exchanger, a tube-in-tube heat exchanger, a tube-on-tube heat exchanger or a shell-and-tube heat exchanger. The economizer circuit expansion device 65 is disposed in refrigerant line 78 upstream with respect to refrigerant flow of the second pass 74 of the refrigerant-to-refrigerant heat exchanger economizer 70 and meters the refrigerant flowing through refrigerant line 78 and the second pass 74 of the refrigerant-to-refrigerant heat exchanger economizer 70. As the expanded refrigerant flow having traversed the economizer circuit expansion device 65 passes through the second pass 74 in heat exchange relationship with the hot, high pressure refrigerant passing through the first pass 72, that refrigerant is evaporated and the resultant refrigerant vapor passes into refrigerant line 28 to be admitted to the second compression stage 30*b*.

To improve the energy efficiency and cooling capacity of the refrigerant vapor compression system 20, particularly when operating in a transcritical cycle and charged with carbon dioxide or a mixture including carbon dioxide as the refrigerant, the refrigerant vapor compression system 20 includes an intercooler 80 interdisposed in refrigerant line 28 of the primary refrigerant circuit between the first compression stage 30*a* and the second compression stage 30*b*, as depicted in FIGS. 2-7. The intercooler 80 comprises a refrigerant-to-secondary fluid heat exchanger, such as for example a finned tube heat exchanger 82, through which intermediate temperature, intermediate pressure refrigerant passing from the first compression stage 30*a* to the second compression stage 30*b* passes in heat exchange relationship with ambient air drawn through the heat exchanger 82 by the fan(s) 44. The finned tube heat exchanger 82 may comprise, for example, a fin and round tube heat exchange coil or a fin and flat mini-channel tube heat exchanger.

In the depicted embodiments, the intercooler 80 is located in the air stream at the air outlet of the refrigerant heat rejection heat exchanger 40. In this arrangement, the ambient air drawn by the fan(s) 44 passes first through the refrigerant heat rejection heat exchanger 40 in heat exchange relationship with the hot, high pressure refrigerant vapor passing through the heat exchanger coil 42 and thereafter passes through the intercooler 80 in heat exchange relationship with the intermediate temperature and intermediate pressure refrigerant passing through the intercooler hear exchanger 82. In this arrangement, the refrigerant passing through the refrigerant heat rejection heat exchanger 40 will be cooled by the incoming ambient air stream, thereby more effectively reducing the temperature of the refrigerant leaving the refrigerant heat rejection heat exchanger 40, which is critical for the system cooling capacity and energy efficiency, particularly when the refrigerant vapor compression system 20 is operating in a transcritical cycle with carbon dioxide refrigerant.

Figure 5:
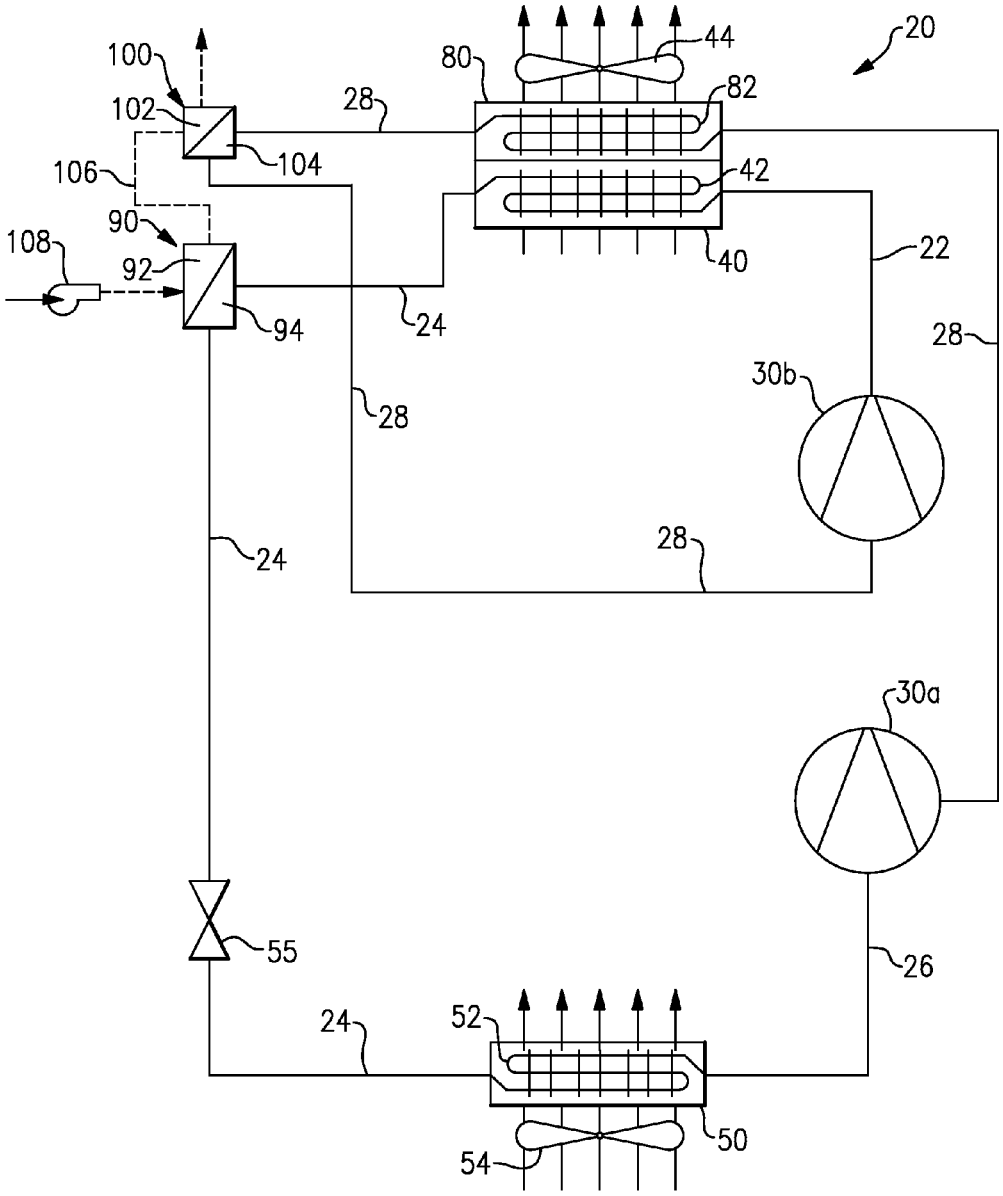
FIG. 5 is a schematic illustration of an embodiment of the refrigerant vapor compression system in accord with an aspect of the invention.

The refrigerant vapor compression system 20 may also include a second refrigerant heat rejection heat exchanger 90 and a second intercooler 100, such as depicted in FIGS. 5-7, that are not cooled by air, but instead are cooled by a secondary liquid, such as for example water. However, it is to be understood that other liquids, such as for example glycol or glycol/water mixtures, could be used as the secondary fluid. The second refrigeration heat rejection heat exchanger 90 comprises a refrigerant-to-liquid heat exchanger having a secondary liquid pass 92 and a refrigerant pass 94 arranged in heat transfer relationship. The refrigerant pass 94 is interdisposed in refrigerant line 24 and forms part of the primary refrigerant circuit. In operation, refrigerant having traversed the heat exchanger coil 42 of the refrigerant heat rejection heat exchanger 40 passes through the refrigerant pass 94 of the second refrigerant heat rejection heat exchanger 90 in heat exchange relationship with the secondary fluid, for example water, passing through the secondary liquid pass 92 whereby the refrigerant is further cooled. The secondary fluid pass 92 and the refrigerant pass 94 of the second refrigerant heat rejection heat exchanger 90 may be arranged in a parallel flow heat exchange relationship or in a counter flow heat exchange relationship, as desired. The second refrigerant heat rejection heat exchanger 90 may be a brazed plate heat exchanger, a tube-in-tube heat exchanger, a tube-on-tube heat exchanger or a shell-and-tube heat exchanger.

The second intercooler 100 comprises a refrigerant-to-liquid heat exchanger having a secondary liquid pass 102 and a refrigerant pass 104 arranged in heat transfer relationship. The refrigerant pass 104 is interdisposed in refrigerant line 28 that interconnects the first compression stage 30*a* in refrigerant flow communication with the second compression stage 30*b* and forms part of the primary refrigerant circuit. In operation, refrigerant having traversed the heat exchanger 82 of the intercooler 80 passes through the refrigerant pass 104 of the second intercooler 100 in heat exchange relationship with the secondary fluid, for example water, passing through the secondary liquid pass 102 whereby the refrigerant is cooled interstage of the first compression stage 30*a* and the second compression stage 104. The secondary fluid pass 102 and the refrigerant pass 104 of the second intercooler 100 may be arranged in a parallel flow heat exchange relationship or in a counter flow heat exchange relationship, as desired. The second intercooler 100 may be a brazed plate heat exchanger, a tube-in-tube heat exchanger, a tube-on-tube heat exchanger or a shell-and-tube heat exchanger.

As depicted in FIGS. 5-7, the second intercooler 100 is disposed downstream with respect to water flow of the second condenser 90. That is, the cooling water, or other secondary cooling liquid, is pumped through the secondary cooling liquid line 106 by an associated pump 108 to first flow through the secondary fluid pass 92 in heat exchange relationship with the refrigerant flowing through the refrigerant pass 94 of the second refrigerant heat absorption heat exchanger and thence through the secondary liquid pass 102 in heat exchange relationship with the refrigerant flowing through the refrigerant pass 104 of the second intercooler 100. In this arrangement, the refrigerant passing through the second refrigerant heat rejection heat exchanger 90 will be cooled by the incoming flow of cooling water, thereby more effectively reducing the temperature of the refrigerant passing through the refrigerant pass 94, which is critical for the system cooling capacity and energy efficiency, particularly when the refrigerant vapor compression system 20 is operating in a transcritical cycle with carbon dioxide refrigerant. However, it is to be understood that the second intercooler 100 may instead be disposed with refrigerant pass 104 upstream of refrigerant pass 94 of the second refrigerant heat rejection heat exchanger 90 with respect to the flow of cooling water through the secondary cooling liquid line 106, if desired.

Figure 8:
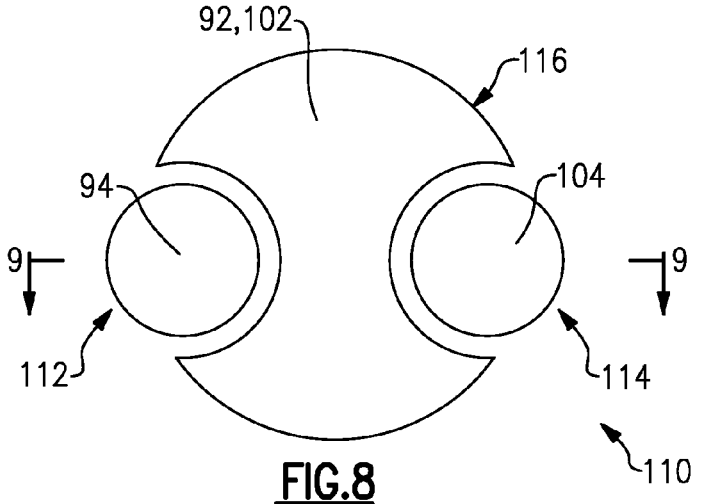
FIG. 8 is a sectioned elevation view of an exemplary embodiment of an intercooler in accordance with an aspect of the invention.
Figure 9:
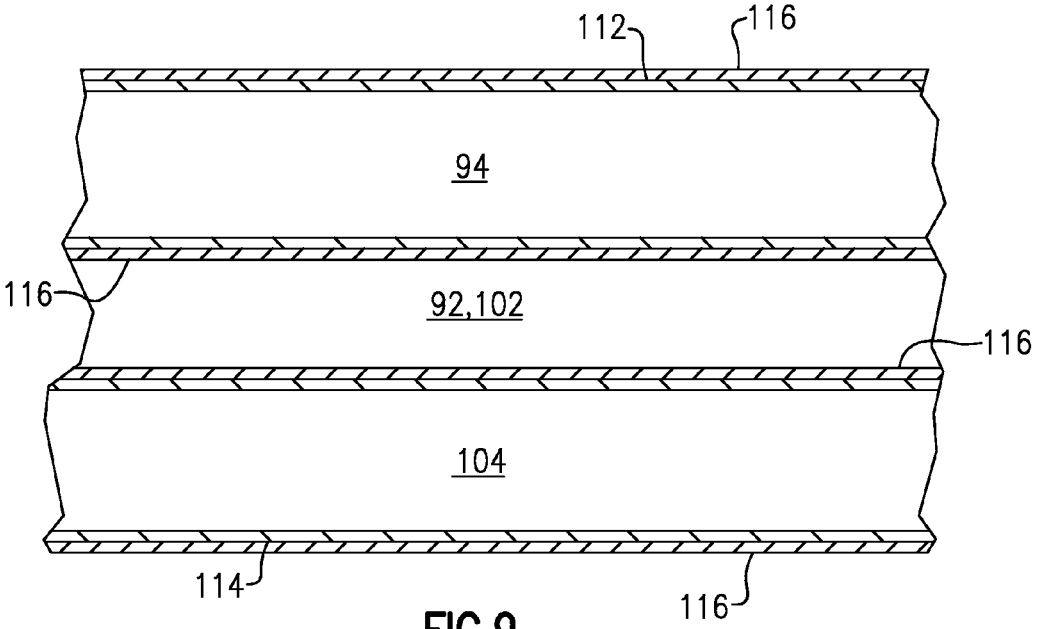
FIG. 9 is a sectioned plan view taken along line 9-9 of FIG. 8.

The second refrigerant heat rejection heat exchanger 90 and the second intercooler 100 may also be disposed in parallel flow relationship with respect to the flow of cooling water. For example, the second refrigerant heat rejection heat exchanger 90 and the second intercooler 100 may comprise a double tube-on-tube heat exchanger 110 having two refrigerant tubes disposed in close contact with a single cooling water tube. For example, referring now to FIGS. 8 and 9, the double tube-on-tube heat exchanger 110 includes a first refrigerant tube 112 defining the refrigerant pass 94 of the second refrigerant heat rejection heat exchanger 90, a second refrigerant tube 114 defining the refrigerant pass 104 of the second intercooler 90, and a cooling water tube 116 defining in combination both the cooling water pass 92 of the second refrigerant heat rejection heat exchanger 90 and the cooling water pass 102 of the intercooler 100. The first and second refrigerant tubes 112, 114, respectively, may be disposed on opposite sides of the cooling water tube 116 so as to flank the cooling water tube 116 and lie in close contact with the cooling water tube 116 thereby facilitating heat exchange between the respective refrigerant flows passing through refrigerant passes 94, 104 defined by the first and second refrigerant tubes 114, 116, respectively, with the cooling water flowing through the combined secondary cooling liquid passages 92, 102 defined by the centrally disposed cooling water tube 116. The direction of flow of the refrigerant flows passing through the refrigerant passes 94, 104 relative to the cooling water flow passing through the cooling water tube 116 may be arranged with both refrigerant flows in a counterflow arrangement with the cooling water flow, with both refrigerant flows in a parallel flow arrangement with the cooling water flow, or with one of the refrigerant flows in a counterflow arrangement with the cooling water flow and the other of the refrigerant flows in a parallel flow arrangement with the cooling water flow.

Refrigerant vapor compression systems used in transport refrigeration applications are subject to a wide range of outdoor ambient conditions over which the refrigerant vapor compression system must operate. Under some conditions, it may not be desirable to operate the refrigerant vapor compression system 20 with the refrigerant vapor passing from the first compression stage to the second compression stage passing through an intercooler. For example, under low ambient air temperature conditions, refrigerant vapor passing from the first compression stage to the second compression stage could actually condense, partially or even fully, to liquid refrigerant in traversing the intercooler. Such a situation is to be avoid as liquid refrigerant entering the compression device 30 would be detrimental to performance and could result in damage to the compression device 20.

Figure 10:
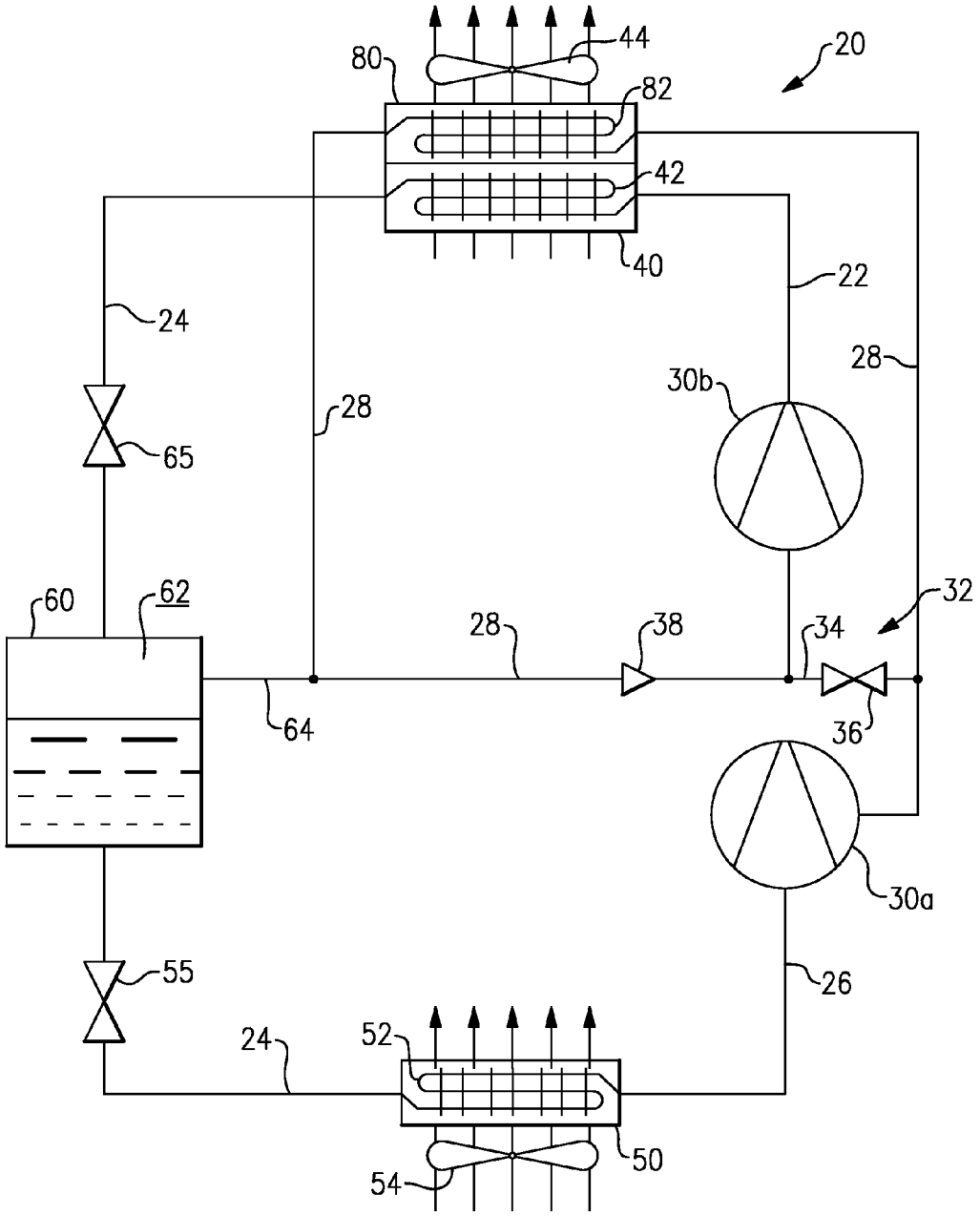
FIG. 10 is a schematic illustration of an exemplary embodiment of the refrigerant vapor compression system incorporating an intercooler bypass circuit.

Accordingly, referring now to FIG. 10, the refrigerant vapor compression systems 20 disclosed may further include an intercooler bypass circuit 32 including a bypass line 34, and a selectively operable bypass valve 36 disposed in the bypass line 34. The bypass valve 36 may be a selectively positionable valve having a fully open position and a fully closed position, such as for example a two position, open/closed solenoid valve. With the bypass valve 36 in an open position, refrigerant flow communication is established through bypass line 34 directly between the outlet of the first compression stage **30*a* and the inlet of the second compression stage 30*b*, whereby substantially all of the refrigerant vapor discharging from the first compression will flow through bypass line 34 to the second compression stage without traversing the intercooler 80. Although the bypass circuit 32 is illustrated in FIG. 10 incorporated in the embodiment of the refrigerant vapor compression system 20 depicted in FIG. 3, it is to be understood that the intercooler bypass circuit 32 may be similarly incorporated in the various embodiments of the refrigerant vapor compression system 20 as depicted in any of FIGS. 2-7**.

The terminology used herein is for the purpose of description, not limitation. Specific structural and functional details disclosed herein are not to be interpreted as limiting, but merely as basis for teaching one skilled in the art to employ the present invention. Those skilled in the art will also recognize the equivalents that may be substituted for elements described with reference to the exemplary embodiments disclosed herein without departing from the scope of the present invention.

While the present invention has been particularly shown and described with reference to the exemplary embodiments as illustrated in the drawing, it will be recognized by those skilled in the art that various modifications may be made without departing from the spirit and scope of the invention. Therefore, it is intended that the present disclosure not be limited to the particular embodiment(s) disclosed as, but that the disclosure will include all embodiments falling within the scope of the appended claims.

We claim:

1. A refrigerant vapor compression system comprising:

a compression device having at least a first compression stage and a second compression stage arranged in series refrigerant flow relationship;

a first refrigerant heat rejecting heat exchanger disposed downstream with respect to refrigerant flow of the second compression stage for passing the refrigerant in heat exchange relationship with a first secondary fluid;

a second refrigerant heat rejecting heat exchanger disposed downstream with respect to refrigerant flow of the first refrigerant heat rejecting heat exchanger for passing the refrigerant in heat exchange relationship with a second secondary fluid;

a first refrigerant intercooler disposed intermediate the first compression stage and the second compression stage for passing the refrigerant passing from the first compression stage to the second compression stage in heat exchange relationship with the first secondary fluid; and a second refrigerant intercooler disposed intermediate the first compression stage and the second compression stage and downstream with respect to refrigerant flow of the first refrigerant intercooler for passing the refrigerant passing from the first compression stage to the second compression stage in heat exchange relationship with the second secondary fluid.

2. The refrigerant vapor compression system as recited in claim 1 wherein the first refrigerant heat rejection heat exchanger operates at least in part at a refrigerant pressure and refrigerant temperature in excess of a critical point of the refrigerant.

3. The refrigerant vapor compression system as recited in claim 2 wherein the refrigerant comprises carbon dioxide.

4. The refrigerant vapor compression system as recited in claim 1 wherein the first secondary fluid comprises air and the second secondary fluid comprises at least one of water and glycol.

5. The refrigerant vapor compression system as recited in claim 4 further comprising at least one fan operatively associated with the first refrigerant heat rejection heat exchanger and with the first refrigerant intercooler for moving the flow of air first through the first refrigerant heat rejection heat exchanger and thence through the first refrigerant intercooler.

6. The refrigerant vapor compression system as recited in claim 4 further comprising a pump operatively associated with the second refrigerant heat rejection heat exchanger and with the second refrigerant intercooler for moving the flow of the second secondary fluid first through the second refrigerant heat rejection heat exchanger and thence through the second refrigerant intercooler.

7. The refrigerant vapor compression system as recited in claim 1 further comprising an intercooler bypass circuit for selectively establishing refrigerant flow communication from the first compression stage to the second compression stage without passing through the first refrigerant intercooler.

8. The refrigerant vapor compression system as recited in claim 7 wherein the second secondary fluid comprises at least one of water and glycol.

9. A refrigerated container for use in transporting perishable goods including a refrigeration system incorporating the refrigerant vapor compression system as recited in claim 1.

* * * * *